US009238166B1

(12) United States Patent
Vesligaj

(10) Patent No.: US 9,238,166 B1
(45) Date of Patent: Jan. 19, 2016

(54) PUTTER WITH ALIGNMENT DEVICE

(71) Applicant: Zeljko Vesligaj, Burgaw, NC (US)

(72) Inventor: Zeljko Vesligaj, Burgaw, NC (US)

( * ) Notice: Subject to any disclaimer, the term of this patent is extended or adjusted under 35 U.S.C. 154(b) by 0 days.

(21) Appl. No.: 14/474,614

(22) Filed: Sep. 2, 2014

(51) Int. Cl.
*A63B 69/36* (2006.01)
*A63B 53/04* (2015.01)
*A63B 53/06* (2015.01)

(52) U.S. Cl.
CPC ..... *A63B 69/3685* (2013.01); *A63B 53/0487* (2013.01); *A63B 53/065* (2013.01); *A63B 2053/0441* (2013.01); *A63B 2069/3679* (2013.01)

(58) Field of Classification Search
CPC ..... A63B 53/0487; A63B 53/065; A63B 69/3676; A63B 69/3685
USPC ..... 473/231–255, 339
See application file for complete search history.

(56) References Cited

U.S. PATENT DOCUMENTS

| | | | | | |
|---|---|---|---|---|---|
| 2,517,245 | A | * | 8/1950 | Scott | 473/339 |
| 3,292,928 | A | * | 12/1966 | Billen | 473/244 |
| 3,360,268 | A | * | 12/1967 | Molinari | 473/244 |
| 3,529,830 | A | * | 9/1970 | Palotsee | 473/244 |
| 3,548,504 | A | | 12/1970 | Zykes | |
| 3,622,159 | A | | 11/1971 | Morton | |
| 3,880,430 | A | | 4/1975 | McCabe | |
| 3,909,004 | A | | 9/1975 | Vella | |
| 3,979,125 | A | * | 9/1976 | Lancellotti | 473/233 |
| 4,032,156 | A | | 6/1977 | Clarke | |
| 4,136,877 | A | | 1/1979 | Antonious | |
| 4,291,883 | A | * | 9/1981 | Smart et al. | 473/244 |
| 4,340,229 | A | | 7/1982 | Stuff, Jr. | |
| 4,461,482 | A | | 7/1984 | Bojicic | |
| 4,530,505 | A | | 7/1985 | Stuff | |
| 4,902,014 | A | | 2/1990 | Bontomase et al. | |
| 4,928,971 | A | | 5/1990 | Soles, Jr. | |
| 5,388,827 | A | * | 2/1995 | Reynolds, Jr. | 473/306 |
| 6,471,600 | B2 | * | 10/2002 | Tang et al. | 473/242 |
| 7,186,185 | B2 | | 3/2007 | Nagy | |
| 7,226,362 | B1 | | 6/2007 | Schell et al. | |
| 7,789,764 | B2 | | 9/2010 | Wilson et al. | |
| 7,905,793 | B2 | | 3/2011 | O'Neill | |
| 2006/0183562 | A1 | * | 8/2006 | Hill, IV | 473/236 |
| 2010/0323807 | A1 | * | 12/2010 | Rha | 473/252 |

* cited by examiner

*Primary Examiner* — Sebastiano Passaniti
(74) *Attorney, Agent, or Firm* — Mark S. King; Russell D. Nugent; Humphries & King, P.C.

(57) ABSTRACT

A golf putter with a putter head having a bore extending between its upper and lower surfaces perpendicular to the putter head lower surface, and an alignment guide including a column slidable within the bore between raised and lowered positions, a plate with an outer periphery on the upper end of the column, and an indicator on the upper surface of the putter head around the bore, the indicator being equally visible around the plate periphery when viewed directly over the putter when the alignment device is in the raised position. The alignment device can also include a releasibly attached sighting guide, which includes a sighting bar having a longitudinal axis perpendicular to the putter head front face.

19 Claims, 4 Drawing Sheets

PUTTER WITH ALIGNMENT DEVICE

BACKGROUND OF THE INVENTION (1) Field of the Invention

The present invention relates to a golf putter, and in particular to a golf putter including a retractable alignment device to aid in positioning the putter head with the golfer's head directly over the putter head and the putter head bottom surface parallel to the ground, and the front striking face of the putter being perpendicular to the intended path of the ball, the alignment device being raised for practice and lowered to meet the playing requirements of the United States Golf Association (USGA).

(2) Description of the Prior Art

In order for a golf ball to be struck properly so that it travels along a desired pathway, it is critical for the bottom or sole of the putter head to be parallel to the ground with the golfer's eyes over the putter head, and for the putter head to be positioned so that the strike face of the putter contacts the ball perpendicular to the desired line of travel of the ball. Consistently positioning the putter head to meet these requirements takes practice.

Numerous prior art devices have been proposed to assist the golfer in achieving these skills. However, such devices have been ineffective, have affected the overall function of the putter and/or have rendered the putter unsuitable for USGA approved play. In certain of these devices, the club requires substantial modification to convert the club from one suitable for practice to one suitable for USGA approved play.

Thus, there is continuing need for a golf putter that includes a putter head alignment device to aid in positioning and sighting of the putter head during practice sessions, but which can quickly and easily be changed to meet USGA requirements for use when playing golf.

SUMMARY OF THE INVENTION

The present invention is directed to a golf putter including an alignment device that is raised for practice and lowered into the body of the putter head to permit use of the putter during play. More specifically, the putter of the present invention comprises a putter head having a bore extending through the head between the putter head upper and lower surfaces, and an alignment device that includes a support column slidable between lowered and raised positions within the bore, and a plate, preferably a circular disc, with an outer periphery that is mounted on top of the column. The column, if cylindrical, includes a stop to prevent rotation of the column within the bore. Alternatively, the column and bore can be non-circular, e.g., rectangular or oval.

The alignment device also includes an alignment indicator with a peripheral edge located on top of the putter head around the bore, whereby the indicator is equally visible around the plate periphery when the bottom of the putter is parallel to the ground and the golfer's eyes are directly over the putter head. The indicator may be a metal ring, a plastic ring, a painted indicia, etc., having a color contrasting with that of the plate to provide a visual difference. Preferably, the putter head also includes an annular recess in the upper surface of the putter head around the bore with the outer periphery of the recess being equal to the periphery of the plate, whereby the plate will be nested in the recess.

To ensure that the alignment device column is held in the desired raised or lowered position, a retainer may be incorporated into the putter head to press against the column to resist, but not prevent, movement of the column. For example, a set screw, preferably with a roller ball at its inner tip, can extend through the body of the putter head and against the side of the column.

Additionally, the alignment device may include a sighting guide to aid in positioning the putter face perpendicular to the desired path of the ball. Generally, the sighting guide will comprise an elongated bar detachably mounted to the top of the plate with the bar's longitudinal axis perpendicular to the face of the putter head. The length of the bar is preferably equal to about the longitudinal width of the putter head, i.e., the distance from the back of the putter head to the putter head front face. For some practice, the bar can extend beyond the rear and/or front of the putter head to provide a more easily viewed guide to positioning of the putter relative to the desired direction in which the ball is hit.

Preferably, the sighting bar is releasibly attached to the alignment device with a projection that is inserted into a recess in the top of the plate. For example the projection can be a rectangular blade that is inserted into a rectangular slot that extends from the top of the plate perpendicularly downward into the column of the alignment device. The projection and recess are non-circular so that the bar does not rotate relative to the plate.

When practicing, the golfer raises the alignment device column and plate to their raised positions and places the putter head behind the ball with the bottom or sole of the putter head parallel to the ground and his eyes over the putter head. When the golfer views the indicator equally around the plate periphery, the putter head is correctly aligned.

When the sighting bar is used, the golfer also positions the putter head so that the sighting bar is aligned with the center of the ball and the desired path along which the ball is to be struck, ensuring that the ball will initially travel along the path. Course contour and other factors will, of course, affect the path of the ball as it moves in the direction of the cup.

When the putter is to be used for USGA sanctioned play, the golfer simply removes the sighting bar, if used, and pushes the alignment guide downwardly into its lowered and recessed position so that no alignment aid is further visible.

DETAILED DESCRIPTION OF THE INVENTION

Figure 1:
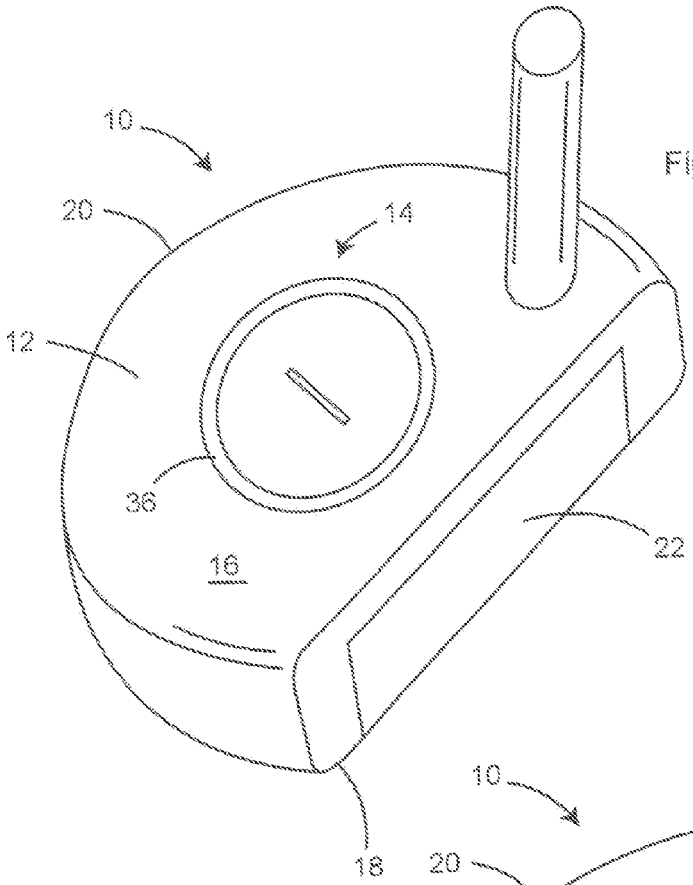
FIG. 1 is a perspective view of a putter of the invention with the alignment device in the lowered or stowed position and without a sighting guide attached.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As illustrated by example in the drawings, putter, generally 10, is comprised of shaft 11, a putter head body 12 and an alignment device, generally 14. Body 12 has a top surface 16, a bottom surface 18, a rear surface 20, a front face 22, and a bore 24 extending between top surface 16 and bottom surface 18, perpendicular to bottom surface 18. Alignment device 14 is comprised of a column 30 having an outer diameter approximating the diameter of bore 24 and a plate 32 on the top of column 30. Plate 32 may be integral with column 30. While plate 32 is illustrated as circular, it will be understood that non-circular plates are also contemplated.

Body 12, as illustrated, also includes an annular recess 34 in top surface 16 surrounding bore 24 sized to receive plate 32 when column 30 is lowered to its recessed position. An annular indicator 36 extends around recess 34 and is a different color from plate 32, e.g., plate 32 can be black or gray, while indicator 36 is white or silver.

Figure 10:
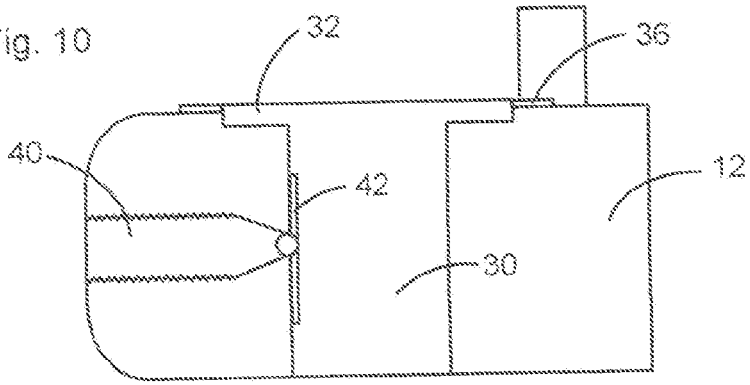
FIG. 10 is a side view of the putter from the toe side with the alignment device in the lowered position showing a retainer projecting into a slot in the column wall to resist movement of the alignment device between raised and lowered positions.

To prevent column 30 from sliding freely within bore 24 between raised and lowered positions, while still permitting movement under reasonable force, a retainer 40, as best illustrated in FIG. 10, extends from rear surface 20 with the tip of retainer 40, which is preferably a ball tip, frictionally engaging column 30 within slot 42. Slot 42 includes upper and lower ends that are engaged by retainer 40 to limit up or down movement of column 30.

Figure 3:
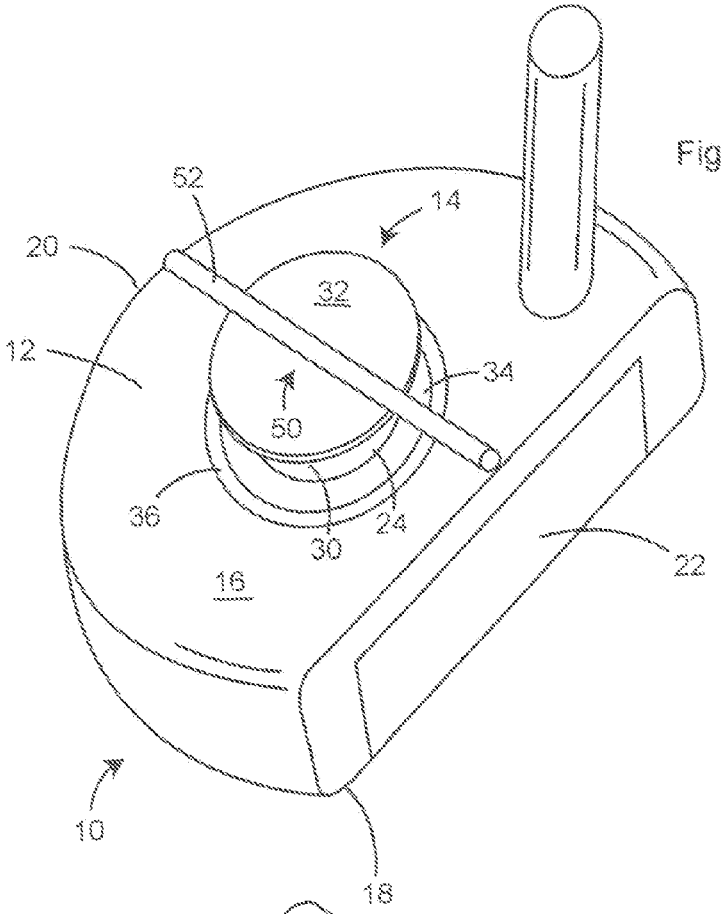
FIG. 3 is a perspective view of a putter of the invention with the alignment device in the raised position and a sighting guide attached.
Figure 4:
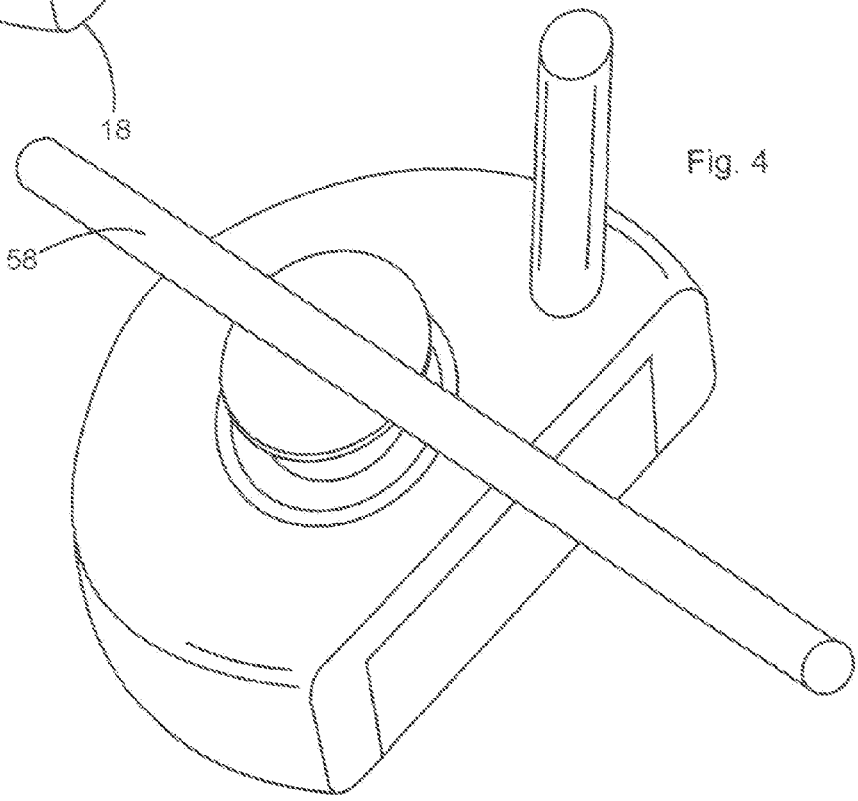
FIG. 4 is a perspective view of a putter of the invention with the alignment device in the raised position and a sighting guide attached.
Figure 11:
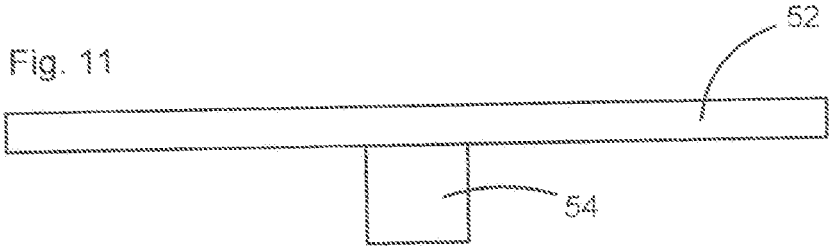
FIG. 11 is a side view of a sighting guide.

As best illustrated in FIGS. 3, 4 and 11, alignment device 14 may also include a sighting guide, generally 50, comprised of a longitudinal bar 52 and an attachment blade 54. Sighting guide 50 is releasibly attached to column 30 by inserting blade 54 into slot 56. Bar 52 may be a shorter bar having a length approximately equal to the back to front width of putter body 12 as shown in FIG. 3, or a longer bar such as bar 58 shown in FIG. 4 may be used. While bar 52 is illustrated as a circular rod, it will be understood that bars with other cross-sections and shapes are contemplated. Guide 50 is mounted so that the longitudinal axis of bar 52 is perpendicular to front face 22.

Figure 2:
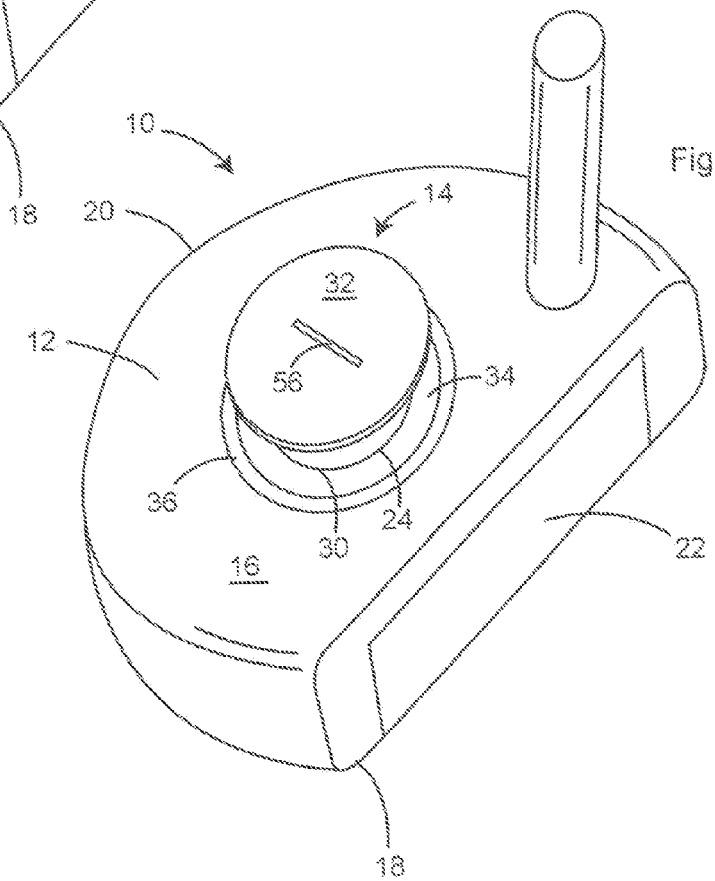
FIG. 2 is a perspective view of a putter of the invention with the alignment device in the raised position and without a sighting guide attached.
Figure 5:
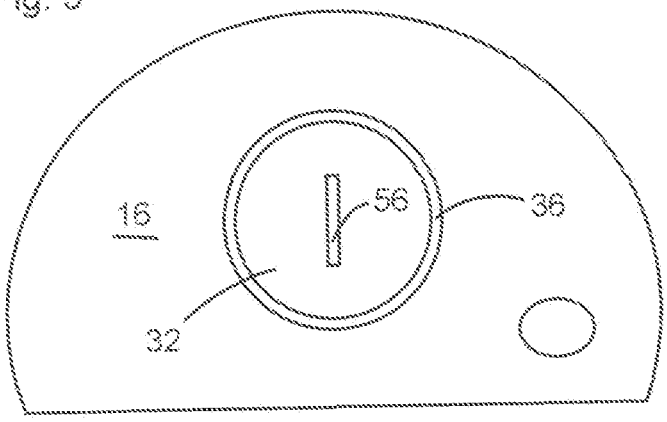
FIG. 5 is a top view of a properly aligned putter.
Figure 6:
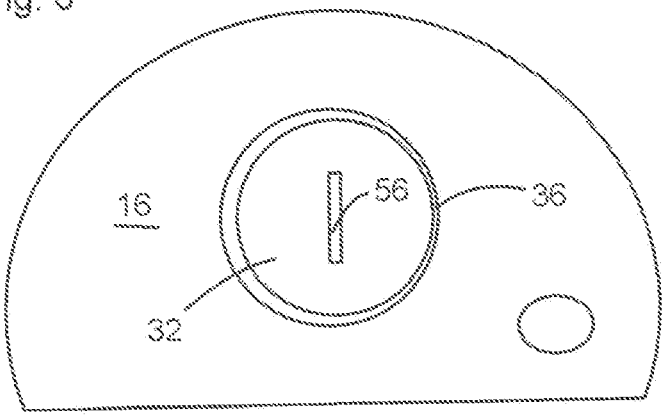
FIG. 6 is a top view of a putter tilted toward the golfer.
Figure 7:
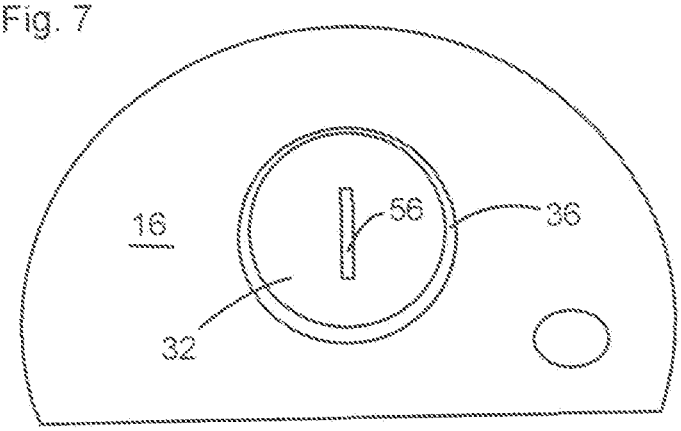
FIG. 7 is a top view of a putter tilted away from the ball.
Figure 8:
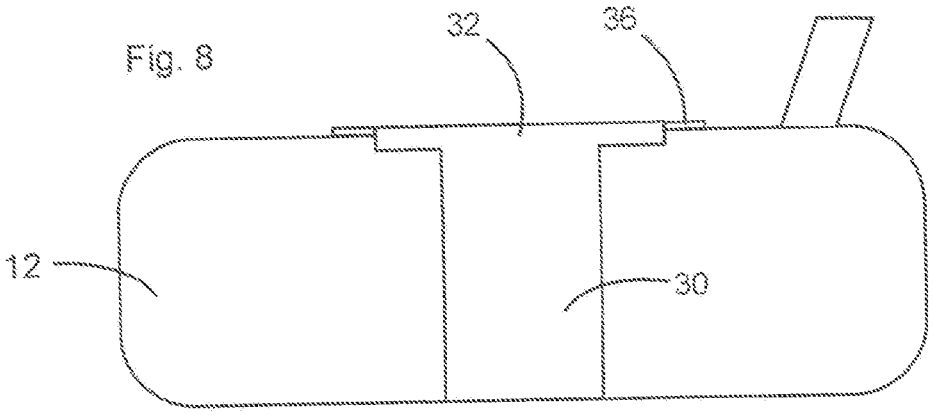
FIG. 8 is a sectional front view of a putter with the alignment device in the lowered position.
Figure 9:
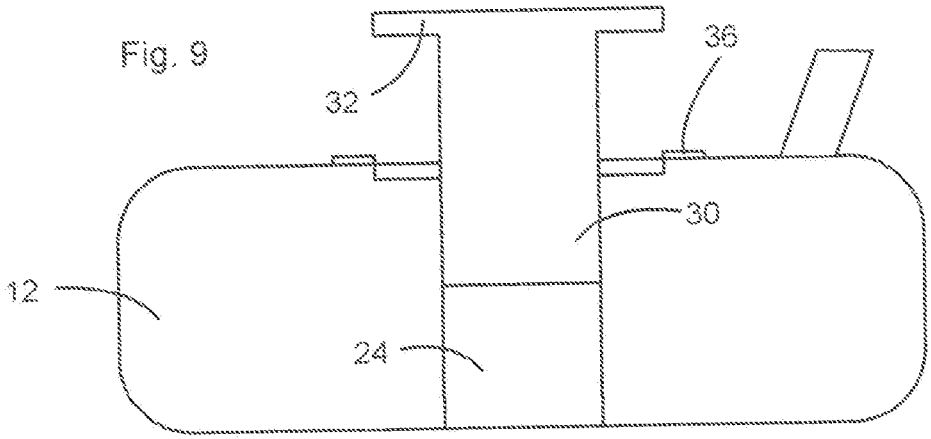
FIG. 9 is a sectional front view of a putter with the alignment device in the raised position.

When the golfer wishes to practice putter alignment, alignment guide 14 is moved to its raised position as shown in FIG. 2. The golfer then places bottom surface 18 on the ground behind the ball and leans forward so that his eyes are over the putter. When the putter and the golfer are properly positioned, indicator 36 will be equally visible around the periphery of plate 32 as illustrated in FIG. 5. If there is incorrect alignment, more of indicator 36 will be visible on one side of plate 32 than on the other side as shown in FIG. 6 where the club is tilted too far toward the golfer or the golfer is looking from the side of the putter head instead of over it, or in FIG. 7 where the club is tilted too far to the rear or the golfer is positioned too far towards the front of the putter.

Alignment device 14 may also be used to practice positioning of the front face of putter perpendicular to the desired line along which the ball is to be hit by attaching sighting guide and aligning bar 52 or 58 with the desired line of ball travel.

When the golfer wishes to use the putter for regular play, sighting guide 50 is removed and column 30 is lowered into putter body 12.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A golf putter including a retractable alignment device comprising:

a) a putter head having upper, lower, front and rear surfaces, and a bore extending through the putter head between said upper and lower surfaces, said bore being perpendicular to said lower surface;

b) an alignment guide including a column with an upper end slidable within said bore between raised and lowered positions, and a plate with an outer periphery on the upper end of said column; wherein said putter head upper surface includes an annular recess around said bore sized to receive said plate when said alignment guide is in its lowered position; and c) an indicator having a peripheral edge and located on the upper surface of said putter head around said bore, said indicator being equally visible around said plate periphery when viewed directly over said putter.

2. The putter of claim 1, further including a sighting guide releasibly attached to said plate, said guide including a sighting bar having a longitudinal axis perpendicular to said putter head front face.

3. The putter of claim 1, further including a retainer to resist movement of said column between raised and lowered positions.

4. The putter of claim 1, wherein said bore is cylindrical and said column is cylindrical with said bore and column having corresponding diameters.

5. The putter of claim 1, wherein said column includes stops limiting movement of said column in said bore.

6. A golf putter including a retractable alignment device comprising:

a) a putter head having upper, lower, front and rear surfaces, and a bore extending between said upper and lower surfaces, said bore being perpendicular to said lower surface;

b) an alignment guide including a column with an upper end slidable within said bore between raised and lowered positions, and a plate with an outer periphery on the upper end of said column; wherein said putter head upper surface includes an annular recess around said bore sized to receive said plate when said alignment guide is in its lowered position;

c) an indicator on the upper surface of said putter head around said bore, said indicator being equally visible around said plate periphery when viewed directly over said putter; and d) a sighting guide releasibly attached to said plate, said guide including a sighting bar having a longitudinal axis perpendicular to said putter head front face.

7. The putter of claim 6, further including a retainer to resist movement of said column between raised and lowered positions.

8. The putter of claim 6, wherein said bore is cylindrical and said column is cylindrical with said bore and column having corresponding diameters.

9. The putter of claim 6, wherein said column includes stops limiting movement of said column in said bore.

10. The putter of claim 6, wherein said sighting bar extends from the rear surface of said putter head to the front face of said putter head.

11. The putter of claim 6, wherein said sighting guide includes a retainer and said column includes a slot extending downwardly through said plate, said retainer frictionally engaging said column in said slot.

12. A golf putter including a retractable alignment device comprising:

a) a putter head having upper, lower, front and rear surfaces, and a bore extending between said upper and lower surfaces perpendicular to said lower surface, and an annular recess around said bore;

b) an alignment guide including a column with an upper end slidable within said bore between raised and lowered positions, and a plate with an outer periphery on the upper end of said column; wherein said annular recess is sized to receive said plate when said alignment guide is in a lowered position;

c) an indicator on the upper surface of said putter head around said bore, said indicator being equally visible around said plate periphery when viewed directly over said putter; and d) a sighting guide releasibly attached to said plate, said guide including a sighting bar having a longitudinal axis perpendicular to said putter head front face.

13. The putter of claim 12, further including a retainer to resist movement of said column between raised and lowered positions.

14. The putter of claim 12, wherein said indicator is an annular metal ring mounted in said putter head around said bore, said plate being nested inside said ring when said guide is in its lowered position.

15. The putter of claim 12, wherein said sighting bar extends from the rear surface of said putter head to the front face of said putter head.

16. The putter of claim 12, wherein said sighting guide includes a retainer and said column includes a slot extending downwardly through said plate, said retainer frictionally engaging said column in said slot.

17. A golf putter including a retractable alignment device comprising:

a) a putter head having upper, lower, front and rear surfaces, and a bore extending between said upper and lower surfaces, said bore being perpendicular to said lower surface;

b) an alignment guide including a column with an upper end slidable within said bore between raised and lowered positions, and a plate with an outer periphery on the upper end of said column; and c) an indicator on the upper surface of said putter head around said bore, said indicator being equally visible around said plate periphery when viewed directly over said putter; and d) wherein said indicator is an annular metal ring mounted in said putter head around said bore, said plate being nested inside said ring when said guide is in its lowered position.

18. A golf putter including a retractable alignment device comprising:

a) a putter head having upper, lower, front and rear surfaces, and a bore extending between said upper and lower surfaces, said bore being perpendicular to said lower surface;

b) an alignment guide including a column with an upper end slidable within said bore between raised and lowered positions, and a plate with an outer periphery on the upper end of said column; and c) an indicator on the upper surface of said putter head around said bore, said indicator being equally visible around said plate periphery when viewed directly over said putter; wherein said indicator is an annular metal ring mounted in said putter head around said bore, said plate being nested inside said ring when said guide is in its lowered position; and d) a sighting guide releasibly attached to said plate, said guide including a sighting bar having a longitudinal axis perpendicular to said putter head front face.

19. A golf putter including a retractable alignment device comprising:

a) a putter head having upper, lower, front and rear surfaces, and a bore extending between said upper and lower surfaces, said bore being perpendicular to said lower surface;

b) an alignment guide including a column with an upper end slidable within said bore between raised and lowered positions, and a plate with an outer periphery on the upper end of said column; and c) an indicator on the upper surface of said putter head around said bore, said indicator being equally visible around said plate periphery when viewed directly over said putter; and d) a sighting guide releasibly attached to said plate, said guide including a sighting bar having a longitudinal axis perpendicular to said putter head front face; wherein said sighting guide includes a retainer and said column includes a slot extending downwardly through said plate, said retainer frictionally engaging said column in said slot.

* * * * *